US005151077A

United States Patent [19]

Cole, Jr. et al.

[11] Patent Number: 5,151,077

[45] Date of Patent: Sep. 29, 1992

[54] METHOD AND APPARATUS FOR PERFORATING MATERIAL

[75] Inventors: William R. Cole, Jr.; Charles H. Sanborn, III; J. Dwight Clanton, all of Shelbyville, Tenn.

[73] Assignee: ARK, Inc., Shelbyville, Tenn.

[21] Appl. No.: 738,343

[22] Filed: Jul. 31, 1991

[51] Int. Cl.[5] ..... B26F 1/22; B26F 1/24; B26F 1/20

[52] U.S. Cl. ..... 493/353

[58] Field of Search ..... 493/352, 353, 356, 357, 493/363, 365; 83/660, 678

[56] References Cited

U.S. PATENT DOCUMENTS

| | | | |
|---|---|---|---|
| 1,260,694 | 3/1918 | Marresford | 493/363 |
| 2,699,208 | 1/1955 | Schur | 493/363 |
| 2,762,433 | 9/1956 | Russell | 493/353 |
| 3,074,303 | 1/1963 | Waters | 493/369 |
| 3,302,501 | 2/1967 | Greene | 83/2 |
| 3,369,435 | 2/1968 | Boultinghouse | 83/30 |
| 3,408,776 | 11/1968 | Kalwaites | 51/324 |
| 3,460,416 | 8/1969 | Gilbert | 83/30 |
| 3,496,259 | 2/1970 | Guenther | 264/156 |
| 3,496,260 | 2/1970 | Guenther et al. | 264/156 |
| 3,526,349 | 9/1970 | Moro | 225/97 |
| 3,527,393 | 9/1970 | Matsui et al. | 225/97 |
| 3,550,826 | 12/1970 | Salmela | 225/3 |
| 3,658,221 | 4/1972 | McMeekin et al. | 225/97 |
| 3,682,028 | 8/1972 | Clayton et al. | 83/660 |
| 4,370,942 | 2/1983 | Dowding et al. | 83/660 |
| 4,653,363 | 3/1987 | Lang | 83/660 |
| 4,687,153 | 8/1987 | McNeil | 242/56.8 |
| 4,691,606 | 9/1987 | Johnson et al. | 83/660 |
| 4,854,927 | 8/1989 | Reneau et al. | 493/363 |
| 4,977,807 | 12/1990 | Kai et al. | 493/363 |

FOREIGN PATENT DOCUMENTS

| | | | |
|---|---|---|---|
| 0089595 | 9/1983 | European Pat. Off. . | |
| 796678 | 6/1958 | United Kingdom | 493/363 |

*Primary Examiner*—William E. Terrell

*Attorney, Agent, or Firm*—Senniger, Powers, Leavitt & Roedel

[57] ABSTRACT

Apparatus for perforating paper including a roll for holding a supply of paper to be perforated, and a roll for taking up paper from the supply roll. The apparatus moves the paper in a forward direction along a reach extending between the supply roll and the take-up roll at a selected speed so that a perforating roller between the supply roll and the take-up roll can perforate the paper in the reach from edge to edge. The perforating roller is rotated so that its teeth travel in the same direction as the paper at the location of engagement with the paper, but the perforating roller is rotated at a rate such that the speed of the teeth is less than the speed of the paper in the forward direction along the reach. Therefore, the paper moves forward relative the teeth after penetration of the paper so that the teeth form elongate openings extending rearwardly of their points of penetration, tearing away flaps of the paper to form the openings, which flaps remain connected to the paper at the rearward edge of the openings.

14 Claims, 3 Drawing Sheets

METHOD AND APPARATUS FOR PERFORATING MATERIAL

BACKGROUND OF THE INVENTION

This invention relates generally to apparatus and methods for perforating material, and a perforated material produced thereby, and more specifically to apparatus and methods for perforating webs of thin flat material such as paper, and a perforated material produced thereby.

Thin flat materials such as paper are frequently perforated in order to create a line of weakness along which the paper can be torn from a continuous web, into individual sheets. However, the apparatus of the present invention is particularly related to the perforation of paper used as backing for fabric as it is being processed into apparel or the like (referred to in the industry as "kraft" paper). In automated processing of fabric, multiple layers of fabric are frequently held in a stack such as for cutting a pattern from the fabric. In this way, multiple workpieces of fabric can be formed with a single cutting stroke through the layers. The stack of fabric is held in place by suction acting on the bottom layer of the stack. The fabric is air permeable so that the suction is experienced by all of the layers of the stack. A backing of kraft paper is applied to each layer of fabric before processing to protect the bottom layer from dirt, to provide a uniform air permeability for all types of fabric so that the same suction can be applied to hold the fabric, and to prevent adjacent layers of fabric including some polymeric materials from welding together during the cutting process.

Kraft paper available from the paper manufacturer is not substantially air permeable. Therefore, so that the paper will be more air permeable, it is perforated to provide openings for passage of air through the paper. The openings must be formed in a uniform manner over the surface area of the paper, and in such a fashion that they do not close up upon the application of suction. In the past, openings have been formed by punching out generally circular pieces of the paper. The process of punching out the openings is slow and produces a large amount of debris (i.e., the circular punch outs). Presently, the perforating process approximately doubles the cost of the kraft paper to the end user.

SUMMARY OF THE INVENTION

Among the several objects and features of the present invention may be noted the provision of apparatus and a method by which thin, flat material such as paper is perforated at a high rate of speed; the provision of such apparatus and method which eliminates debris resulting from the perforation of the material; the provision of such apparatus and method by which openings are formed in the material which will not close upon application of suction to the web; the provision of such apparatus and method by which perforations are formed without substantially weakening the material; and the provision of such apparatus and method by which material may be perforated inexpensively.

Further among the objects and features of the present invention may be noted the provision of a web of perforated material, made according to the method of the present invention, which has uniform openings over its surface area; and the provision of such perforated material which is inexpensive.

Generally, apparatus constructed according to the principles of the present invention comprises means for holding a supply of thin, flat material to be perforated, and means for taking up material from the holding means. A reach of material extending between the holding means and the take-up means has transversely opposite longitudinal edges. The apparatus is adapted to move the material in a forward direction along the reach from the holding means to the take-up means at a selected speed so that perforating means generally between the holding means and the take-up means can perforate the material in the reach generally from edge to edge. The perforating means comprises a perforating roller mounted for rotation about an axis generally parallel to the reach and perpendicular to the direction of travel of the material in the reach. The perforating roller is disposed for engaging the material in the reach and has teeth adapted to pierce the material upon engagement with it. The direction of travel of the teeth at the location of engagement with the material is the same as the direction of travel of the material along the reach. The perforating roller is rotated at a rate such that the speed of the teeth is less than the speed of the material in the forward direction along the reach whereby the material moves forward relative the teeth after penetration of the material so that the teeth form elongate openings extending generally rearwardly of the points of penetration of the teeth. The teeth tear away flaps of the material to form the openings, which flaps remain connected to the material at the rearward edge of the openings.

The method of the present invention generally comprises the function of the apparatus described above. The perforated web of material of the present invention generally comprises the product of the above-described apparatus.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
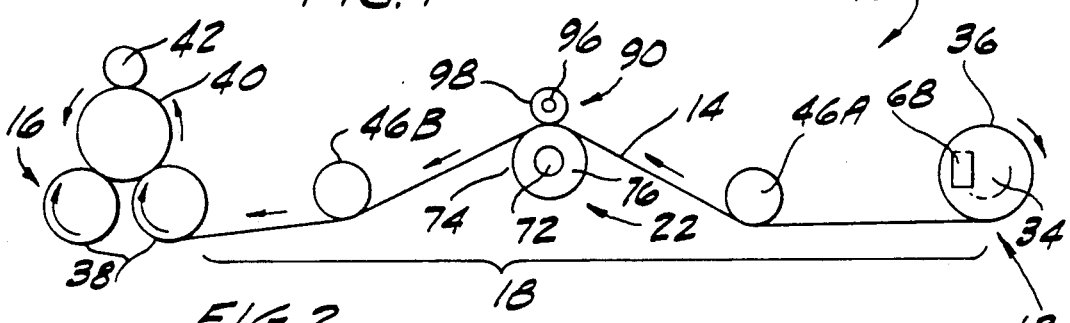
FIG. 1 is a schematic side elevation of the apparatus of the present invention.
Figure 2:
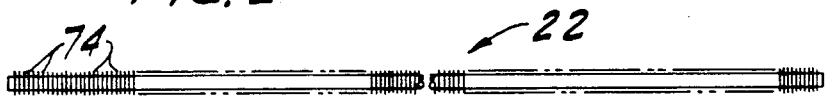
FIG. 2 is a front elevation of a perforating roller of the apparatus.
Figure 3:
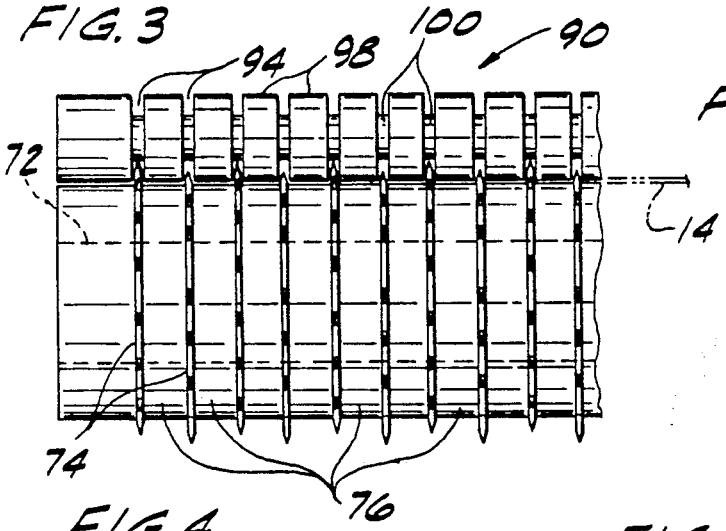
FIG. 3 is an enlarged, fragmentary front elevation of the perforating roller and a compression roller of the apparatus.

Referring now to the drawings, and in particular to FIG. 1, apparatus indicated generally at 10 is shown to comprise means 12 for holding a supply of thin, flat material such as kraft paper 14 to be perforated, and means 16 for taking up the material. A reach 18 of the material 14 extending between the holding means 12 and the take-up means 16 has opposite longitudinal edges E (one of which is shown in FIG. 3). The apparatus 10 is adapted to move the paper 14 in a forward direction along the reach 18 (as indicated by the arrows in FIG. 1) at a selected speed from the holding means 12 to the take-up means 16. Means comprising a perforating roller 22 located between the holding means 12 and the take-up means 16 perforates the paper 14 in the reach 18 generally from edge to edge. The perforating roller 22 is mounted for rotation about an axis parallel to the reach 18 and perpendicular to the direction of travel of the paper in the reach, and disposed for engaging the paper in the reach. The perforating roller 22 has teeth 24 which pierce the paper 14 upon engagement with it. The perforating roller 22 is rotated so that the direction of travel of the teeth 24 is the same as the direction of travel of the paper 14 in the reach 18 over the area of engagement of the paper with the perforating roller.

The perforating roller 22 is rotated at a rate such that the instantaneous speed of the teeth 24 is less than the speed of the paper 14 in the forward direction along the reach 18. The speed difference between the teeth 24 and the paper 14 causes the paper to move forward with respect to the teeth after the paper is pierced by the teeth. As a result, the teeth 24 form elongate triangular openings 26 generally uniformly over the surface area of the paper. The openings 26 extend rearwardly of the point of penetration. The teeth 24 tear away generally triangular flaps 28 of paper to form the openings 26. The flaps 28 remain attached to the paper 14 generally at the rear edge of the openings 26. Thus, the openings 26 may be formed quickly by the rotating action of the perforating roller 22, and debris is eliminated because the flaps 28 torn away to form the openings remain attached to the paper 14.

Figure 7:
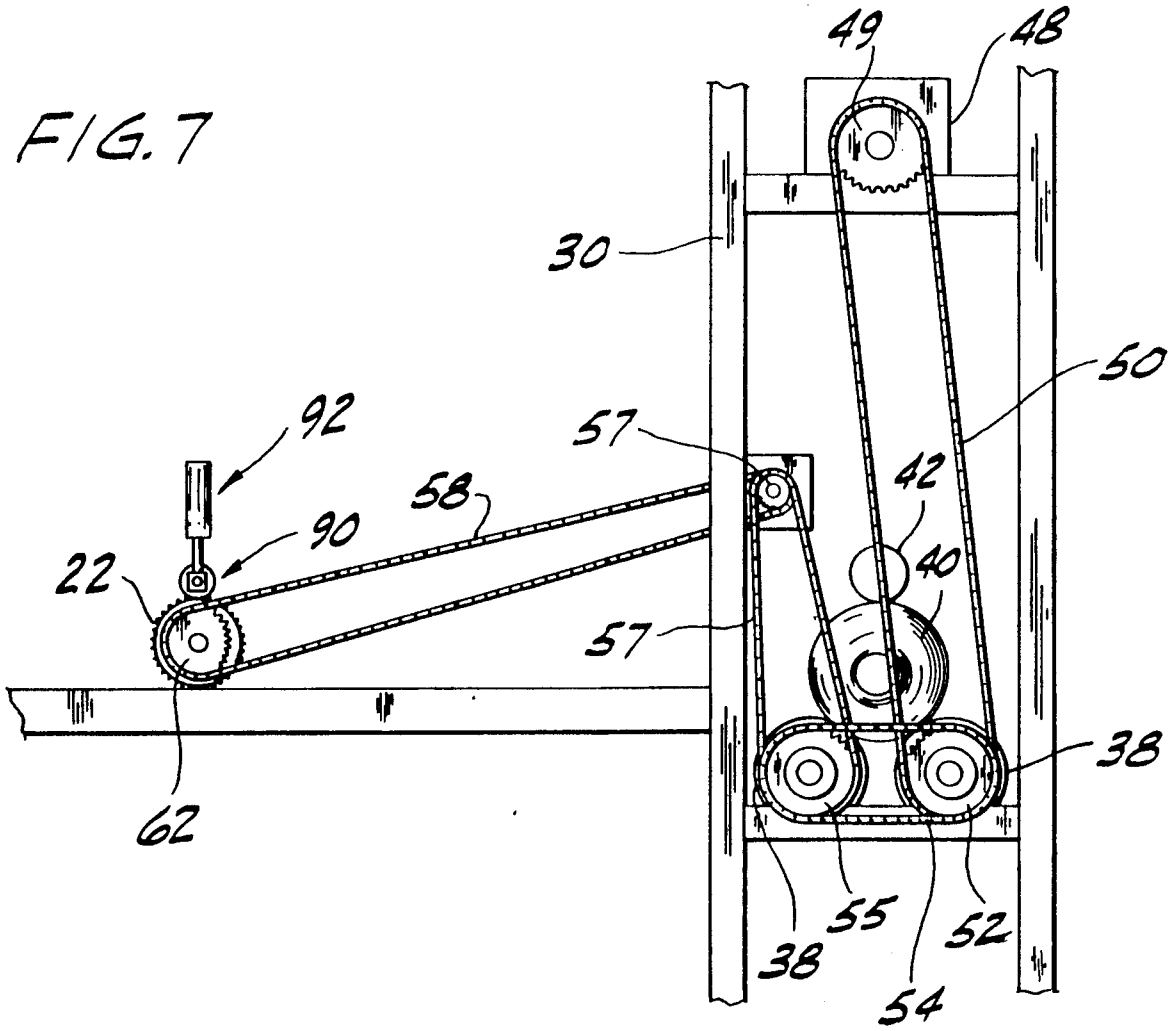
FIG. 7 is a fragmentary elevation of the apparatus.

The apparatus 10 includes a metal frame, indicated generally at 30 in FIG. 7, which supports at least one shaft 34 (i.e., holding means 12) at the rearward end of the frame for holding a supply roll 36 of paper to be perforated. The supply holding shaft 34 is mounted on the frame 30 for rotation about its longitudinal axis to dispense the paper 14 forwardly into the reach 18. The frame 30 also supports at least one pair of take-up rollers 38 generally at the front end of the frame forming a cradle to hold a roll 40 of paper taken up from the supply roll 36 on the supply holding shaft 34. A presser roller 42 mounted on the frame 30 for rotation about its longitudinal axis and for movement vertically engages the paper 14 in the take-up roll 40 and presses the paper so that it is wound relatively tightly and compactly in the take-up roll. Idler rollers, designated 46A and 46B, respectively, mounted on the frame 30 on either side of the perforating roller 22 engage the paper 14 in the reach 18 and help to maintain tension in the reach so that the motion of the paper along the reach is smooth, particularly during start-up of the apparatus 10 so that concentrations of stress in the reach and tearing of the paper 14 is avoided. The apparatus 10 has been found to operate satisfactorily without the idler 46B between the take-up rollers and the perforating roller 22.

As shown in FIG. 7, an electric motor 48 drives a sprocket gear 49 which is connected by a drive chain 50 to a sprocket gear 52 on a first of the take-up rollers 38, which is, in turn, connected by a second chain 54 to a sprocket gear 55 of the second of the take-up rollers so that the motor drives the take-up rollers at a selected surface speed in the direction indicated by arrows in FIG. 1. The second of the take-up rollers 38 is linked by chains 57 and 58 through an intermediate sprocket gear 60 mounted on the frame 30 to a sprocket gear 62 connected to the perforating roller 22. The speed of the paper 14 in the reach 18 is controlled by the surface speed of the take-up rollers 38. The relative speed of the take-up rollers 38 and the perforating roller 22 is controlled by using sprocket gears (52, 55 and 62) for the take-up rollers and for the perforating roller which have different numbers of teeth so that the rollers are rotated at different rates. The precise sprocket gears chosen depend upon the diameters of the take-up rollers 38 and the perforating roller 22. The sprocket gears are selected so that the surface speed of the perforating roller 22 (i.e., the teeth 24) is preferably approximately 85%-90% of the surface speed of the take-up rollers 38. However, it is to be understood that the surface speed of the perforating roller 22 may be other than 85%-90% and still fall within the scope of the present invention. The surface speed is dependent upon the diameters of the take-up rollers 38 and the perforating roller 22. A disc brake 68 on each end (only one is shown) of the shaft 34 holding the supply roll 36 of paper provides tension for the reach 18 of paper which extends between the supply holding shaft 34 and the take-up rollers 40.

Figure 4:
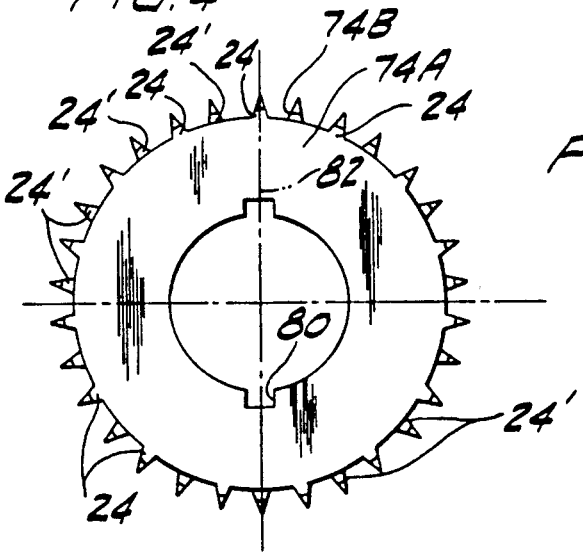
FIG. 4 is an elevation showing two sets of teeth as oriented on the perforating roller.

As shown in FIG. 3, the perforating roller 22 includes a shaft 72 and a plurality of substantially identical annular perforating disks 74. Each disk 74 includes a set of teeth 24 lying generally in the plane of the disk and spaced circumferentially around the periphery of the disk. The disks 74 are located on the shaft 72 at positions spaced axially of the shaft. The axial location is maintained by hollow, cylindrical spacer members 76, which are received on the shaft 72 between adjacent disks 74 and engage the disks. The axial location of the disks 74 on the shaft 72 may be varied by using spacer members 76 which are longer or shorter, as needed. The shaft 72 is formed with a longitudinally extending keys (not shown) and the disks 74 have slots 80 received on the keys so that the disks can be received on the shaft in one of two predetermined orientations. As shown in FIG. 4, a first disk 74A (nearest to the viewer in FIG. 4) is angularly offset with respect to a second disk 74B (shown behind the first disk in FIG. 4). The first disk 74A is oriented so that each of its teeth (designated 24) is aligned with an space between adjacent teeth of the next disk (designated 24').

Figure 4A:
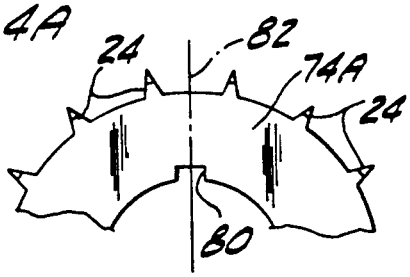
FIG. 4A is a fragmentary elevation of a toothed disk.

The disks 74 are stamped from a blank of sheet metal, and have an odd number of teeth 24 evenly spaced around their peripheries. Each of the teeth 24 on one of the disks 74 is diametrically opposite a space between adjacent teeth 24 on the opposite side of the disk. As is shown in FIG. 4 with respect to the first disk 74A, each tooth 24 lies on a diametric line, such as line 82, which bisects a space between adjacent teeth on the opposite side of the disk. The slots 80 formed on the inside diameter of the disk 74A are also generally bisected by one of these diametric lines. This construction allows the teeth 24 of adjacent disks 74 to be angularly offset although all of the disks are substantially identical. The angular offset between the teeth 24 of adjacent disks 74 on the shaft 72, such as the first disk 74A and the second disk 74B, may be achieved by turning every other disk over about a diametrically extending axis 84 which is perpendicular to the diametric line 82 bisecting the slots 80. For example, rotation of the first disk 74A about a the diametrically extending axis 84 from its position shown in FIG. 4 to a position shown in FIG. 4A, would bring the space between adjacent teeth 24, formerly located at the bottom of the disk, as oriented in FIG. 4, to a location previously occupied by a tooth at the top of the disk.

The teeth 24 of adjacent disks 74 are preferably angularly offset (i.e., out of axial alignment) so that only every other opening 26 formed by the teeth lies on a line extending perpendicularly to the direction of travel of the paper 14 in the reach 18. The increase in lateral spacing between transversely aligned openings prevents the formation of a line of weakness perpendicular to the direction of travel of the paper in the reach. A line of weakness perpendicular to the direction of travel of the paper 14 could cause the paper to tear under the forces applied to the paper in the direction of travel during operation of the apparatus 10, particularly during start-up of the apparatus.

Figure 5:
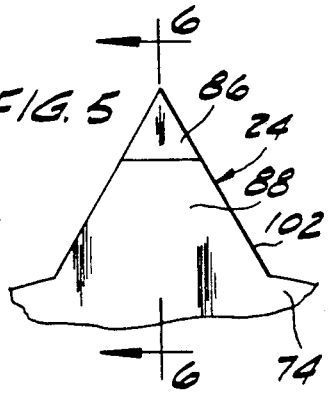
FIG. 5 is an enlarged, fragmentary elevation of a tooth.
Figure 6:
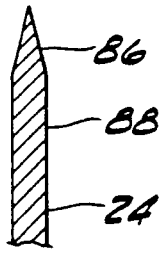
FIG. 6 is a section taken in the plane including line 6—6 of FIG. 5.

The teeth 24 are generally triangular in shape and project radially outwardly from the periphery of the disks 74. Referring now to FIGS. 5 and 6, it may be seen that each tooth 24 includes an upper portion 86 and a lower portion 88. The upper portion 86 is sharpened to a point to facilitate penetration of the paper 14. The lower portion 88 of each tooth 24 is unsharpened to facilitate formation of the flap 28 of paper, as described more fully below.

A compression roller 90 mounted by air cylinders 92 on the frame 30 above the perforating roller 22 presses the paper 14 against the teeth 24 of the perforating roller 22. The pressure applied by the compression roller 90 may be adjusted by raising or lowering the roller through action of the air cylinders 92. The compression roller 90 has a plurality of circumferentially extending channels 94 disposed for receiving the teeth 24 of the perforating roller 22. The depth of the channels 94 is greater than the height of the teeth 24 so that there is no engagement of the teeth with the compression roller 90. The compression roller 90 includes a shaft 96 on which may be alternately received large diameter cylinders 98 and small diameter cylinders 100. The large and small diameter cylinders 98, 100 are sized so that, as placed on the shaft 96, the distance between the centers of the small cylinders is substantially the same as the distance between adjacent perforating disks 74 with the large cylinders being aligned with a space between adjacent disks. Generally, variations in the spacing between adjacent disks 74 is accommodated by providing small diameter cylinders of correspondingly different length.

The method of the present invention includes the steps of moving the paper 14 along a reach 18 in a forward direction at a selected speed and providing the perforating roller 22 for engaging and perforating the paper. The perforating roller 22 is rotated at a rate such that the speed of the teeth 24 is slower than the speed of the paper 14 and preferably between 85% to 90% of the speed of the paper. The teeth 24 initially engage the paper 14 with their sharpened upper portions 86 which penetrate the paper. The lower portions 88, which are wider and relatively blunt, follow through the paper 14, widening the openings 26 started by the upper portions 86. The relative motion between the paper 14 and the teeth 24 as a result of the speed differential causes the paper to move forward against the relatively blunt rear edge 102 of the lower portion 88 of each tooth. The rear edge 102 tears away the paper 14 in the form of the generally triangular flap 28. The action of the paper 14 against the tooth 24 also causes the flap 28 to be folded upwardly and rearwardly. The tooth 24 is then withdrawn, by continued rotation of the perforating roller 22, from the opening 26. The opening 26 is longer in the direction of travel of the paper 14 than the width of the tooth 24 at the point of greatest penetration because of the relative motion between the paper and the tooth. The flap 28 formed by the tooth 24 is left attached to the paper 14 at the rearward edge of the opening 26. Tearing by the relatively blunt rear edge 102 of the lower portion 88 of the teeth 24 is preferable because it forms an opening having a definite width. Cutting with a completely sharpened tooth forms a slit in the paper 14 which will close up upon application of vacuum pressure to the paper, thus eliminating the needed air permeability of the paper.

Figure 9A:
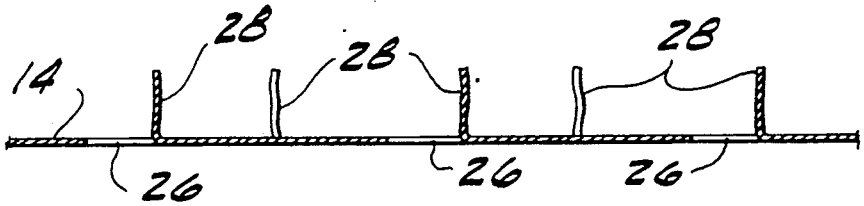
FIG. 9A is a section taken in the plane including line 9—9 of FIG. 8.

After the openings 26 are formed, the paper 14 travels along the reach 18 from the perforating roller 22 to the take-up rollers 38. As shown in FIG. 9A, the flaps 28 of paper project generally upwardly and rearwardly from the rear edge of the openings 26. These flaps 28 are engaged by the take-up roll 40 after leaving the reaching 18 and folded rearwardly against the paper 14 to the position shown in FIG. 9B. This final folding of the flaps 28 helps to assure that the flaps will not move back over the openings 26 upon the application of vacuum pressure. However, the flaps 28 remain attached to the paper 14 so that there is substantially no debris from the perforating process. The elimination of debris allows the perforating process to be conducted more inexpensively than before because the apparatus 10 does not have to be monitored for periodically hauling away scrap paper, and the apparatus does not become fouled with small pieces of waste paper.

Figure 8:
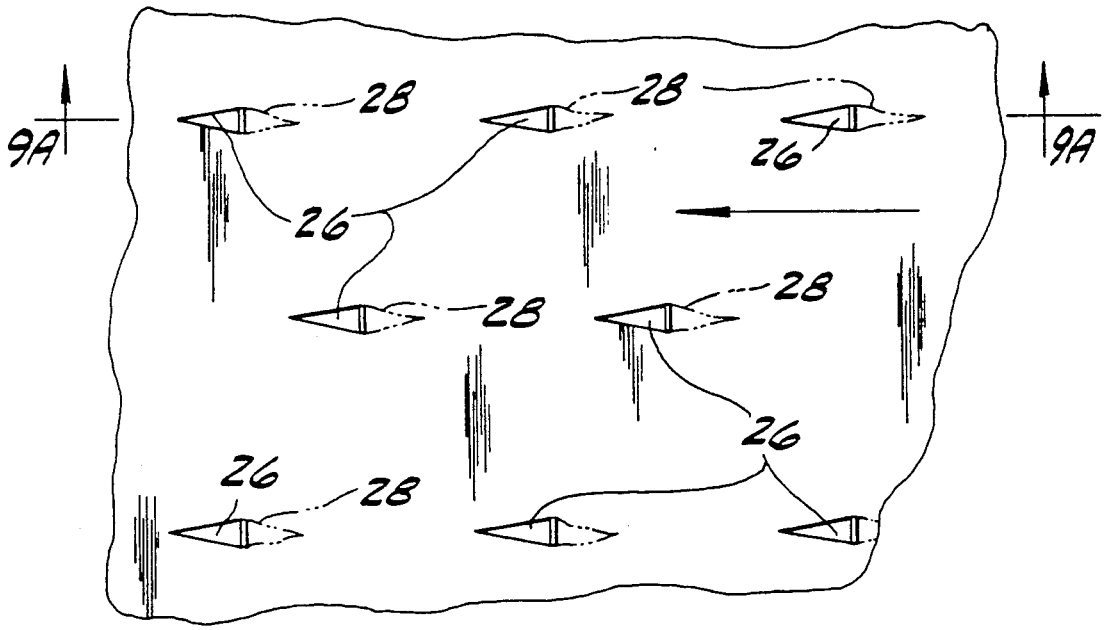
FIG. 8 is a fragmentary plan of paper perforated by the apparatus.
Figure 9B:
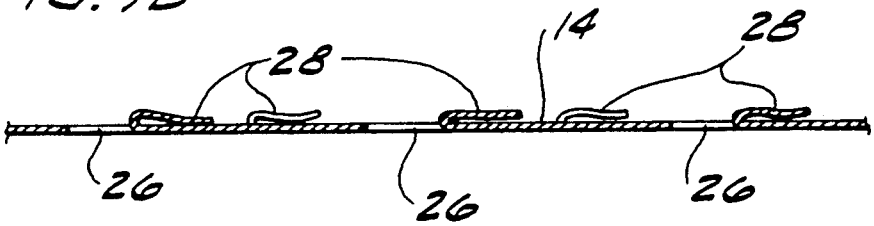
FIG. 9B is the section of FIG. 9A showing the paper after the flaps have been folded rearwardly against the web.

Another aspect of the present invention, as illustrated in FIGS. 8, 9A and 9B, is the provision of a web of the paper 14 which is formed by the method described above. The paper 14 is perforated with triangular openings 26 formed in part by a tearing action in the plane of the paper because the teeth move at a slower speed than the paper. The flaps 28 which are formed by the perforating process remain attached to the paper 14 at the rear edge of the openings 26 and are folded back against the paper 14 so that the openings will not close upon the application of vacuum pressure such as is encountered when the paper is paper used for backing a fabric layer during automated handling of the fabric. The number of openings 26 is selected to provide a desired air permeability of the paper 14 so that an appropriate suction force is transmitted through the paper to the layers of fabric above the paper. The perforated paper 14 may be produced inexpensively, thereby ultimately reducing the production costs for the manufacturers of apparel.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus for perforating paper, the apparatus comprising, means for holding a supply of paper to be perforated, means for taking up paper from said holding means, a reach of paper extending between said holding means and said take-up means having transversely opposite longitudinal edges, means for driving the paper in a forward direction along the reach from said holding means to said take-up means at a selected speed, means generally between said holding means and said take-up means for perforating the paper in the reach generally from edge to edge thereof, said perforating means comprising a perforating roller mounted for rotation about an axis generally parallel to the reach and perpendicular to the direction of travel of the paper in the reach, the perforating roller being disposed for engaging the paper in the reach and including teeth adapted to pierce the paper upon engagement therewith, the direction of travel of the teeth at the location of engagement with the paper being the same as the direction of travel of the paper along the reach, each tooth having an upper portion and a lower portion, the upper portion being sharpened to facilitate penetration of the paper and including a generally triangular shaped planar surface facing rearwardly relative the direction of rotation of the perforating roller, the lower portion being unsharpened and including a generally rectangular shaped planar surface facing generally rearwardly relative to the direction of rotation of the perforating roller, said driving means rotating the perforating roller at a rate such that the speed of the teeth is less than the speed of the paper in the forward direction along the reach whereby the paper moves forward relative the teeth and against the rectangular shaped planar surfaces thereof after penetration of the paper so that the teeth form elongate openings extending generally rearwardly of the points of penetration of the teeth, the teeth tearing away flaps of the paper to form the openings, the flaps remaining connected to the paper at the rearward edge of the openings.

2. Perforating apparatus as set forth in claim 1 wherein said drive means drives the teeth at a speed which is approximately 90 percent or less of the speed of the paper along the reach.

3. Perforating apparatus as set forth in claim 2 wherein said drive means drives the teeth at a speed which is approximately 85 percent or greater of the speed of the paper along the reach.

4. Perforating apparatus as set forth in claim 1 wherein said perforating roller comprises multiple sets of teeth spaced axially of each other along the perforating roller, each set of teeth comprising a plurality of teeth lying generally in a plane perpendicular to the axis of rotation of the perforating roller and spaced circumferentially around the roller, each set of teeth being angularly offset from the adjacent sets of teeth such that each tooth is generally axially aligned with a space between teeth of the immediately adjacent sets of teeth.

5. Perforating apparatus as set forth in claim 4 wherein said perforating roller further comprises a shaft, and a plurality of substantially identical annular disks, each disk including at its periphery one of said sets of teeth, and each tooth on a disk generally lying on a diametric line which bisects a space between adjacent teeth on the opposite side of the disk, the disks and the shaft being constructed to permit reception of each disk on the shaft in one of two predetermined orientations, the teeth of a disk in the first orientation being angularly offset from the teeth in the second orientation.

6. Perforating apparatus as set forth in claim 5 wherein said perforating roller further comprises annular spacer member adapted for reception on the shaft, said spacer members being located between and engaging adjacent disks to maintain the spacing between the disks.

7. Perforating apparatus as set forth in claim 1 further comprising a compression roller for pressing the against the perforating roller, said compression roller having circumferential channels therein adapted to receive the teeth of the perforating roller, the channels having a depth greater than the height of the teeth.

8. Perforating apparatus as set forth in claim 1 wherein a portion of the reach extending between said holding means and the perforating roller lies generally in a plane oriented at an angle of approximately 18 degrees with respect to the horizontal.

9. A method for perforating paper, the method comprising the steps of, moving the paper along a reach in a forward direction at a selected speed, providing a perforating roller having teeth for perforating the paper, the perforating roller being disposed for engagement with the paper, each tooth having an upper portion and a lower portion, the upper portion being sharpened to facilitate penetration of the paper and including a generally triangular shaped planar surface facing rearwardly relative the direction of rotation of the perforating roller, the lower portion being unsharpened and including a generally rectangular shaped planar surface facing generally rearwardly relative to the direction of rotation of the perforating roller to facilitate tearing away a generally triangular flap of material which remains connected to the paper after perforation, rotating the roller at a rate such that the speed of the teeth is less than the speed of the paper along the reach, and in a direction such that the teeth move in generally the same direction as the paper at the location of engagement therewith, the paper being penetrated by the teeth of the roller and moving forward relative the teeth upon penetration of the paper so that the teeth form elongate openings extending generally rearwardly of the points of penetration of the teeth, the teeth tearing away flaps of the paper to form the openings, the flaps remaining connected to the paper at the rearward edge of the openings.

10. The method of claim 9 wherein the perforating roller is rotated so that the speed of the teeth is 90 percent or less of the speed of the material along the reach.

11. The method of claim 10 wherein the perforating roller is rotated so that the speed of the teeth is 85 percent or greater of the speed of the material along the reach.

12. The method of claim 9 further comprising the step of feeding the paper to the perforating roller at an angle of approximately 18 degrees with respect to the horizontal.

13. The method of claim 9 further comprising the step of pressing the paper against the perforating roller.

14. The method of claims 9 further comprising folding the flaps formed by the teeth rearwardly against the paper.

* * * * *